US005088789A

United States Patent [19]

LaPointe et al.

[11] Patent Number: 5,088,789

[45] Date of Patent: Feb. 18, 1992

[54] RETRO-FITTABLE EXTENDABLE LEG REST APPARATUS

[75] Inventors: Larry P. LaPointe, Temperance; Raymond E. Seigle, Jr., Monroe, both of Mich.

[73] Assignee: La-Z-Boy Chair Co., Monroe, Mich.

[21] Appl. No.: 612,206

[22] Filed: Nov. 13, 1990

[51] Int. Cl.[5] ..... A47C 1/022

[52] U.S. Cl. ..... 297/69; 297/435

[58] Field of Search ..... 297/69, 70, 85, 430, 297/429, 431, 435; 108/143; 248/920, 286, 298

[56] References Cited

U.S. PATENT DOCUMENTS

| | | | |
|---|---|---|---|
| 3,695,701 | 10/1972 | Knabush et al. | 297/69 |
| 3,794,381 | 2/1974 | Caldemeyer | 297/430 |
| 4,364,603 | 12/1982 | Johnson | 297/84 |
| 4,410,215 | 10/1983 | McKean et al. | 297/431 |
| 4,644,875 | 2/1987 | Watt | 108/143 |
| 4,718,716 | 1/1988 | Stumpf et al. | 297/85 |

*Primary Examiner*—Kenneth J. Dorner
*Assistant Examiner*—Cassandra Hope
*Attorney, Agent, or Firm*—Harness, Dickey & Pierce

[57] ABSTRACT

A retro-fittable, controllably extendable leg rest apparatus for positioning an attached recliner chair leg rest member in retracted or forwardly extended positions. The apparatus includes an elongated frame bracket which may be retro-fittably secured to most conventional scissor linkage assemblies of various recliners. A mounting bracket is included having a first bracket portion secured to the leg rest member, and a second bracket portion having an elongated channel. A plurality of rivets extend through the elongated channel to secure the mounting bracket to the elongated frame bracket. The shanks of the rivets provide guide members upon which the elongated channel of the mounting bracket may slide. A spring is coupled in between a shoulder portion of the mounting bracket and the elongated frame bracket to bias the mounting bracket in a normally retracted position. A latching member is pivotally secured to a portion of the scissor linkage assembly to releasably latch the mounting bracket in the forwardly extended position. The apparatus is extended to the forwardly extended position by applying an outward force to the inner edge of the leg rest member when the scissor linkage is fully protracted, thereby causing the mounting bracket to slide along the shanks of the rivets until the latching member latches with a latching edge surface of the mounting bracket. When the scissor linkage assembly is manually retracted, the latching member is urged out of engagement with the latching edge surface, thus enabling the spring to forcibly return the mounting bracket to and maintain it in the retracted position.

11 Claims, 5 Drawing Sheets

FIG 6
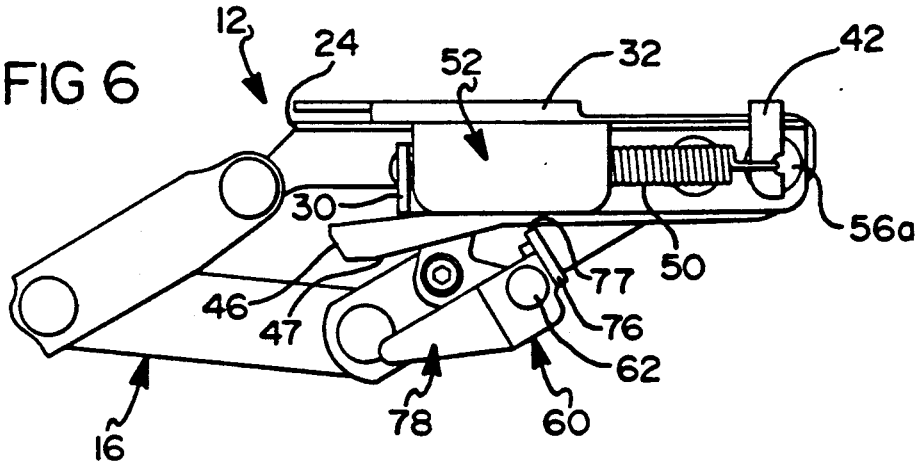
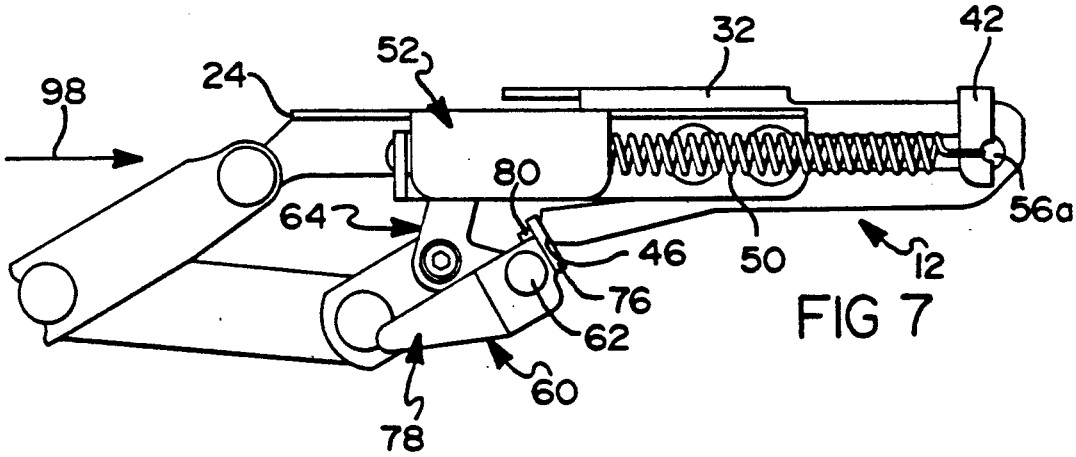
FIG 7
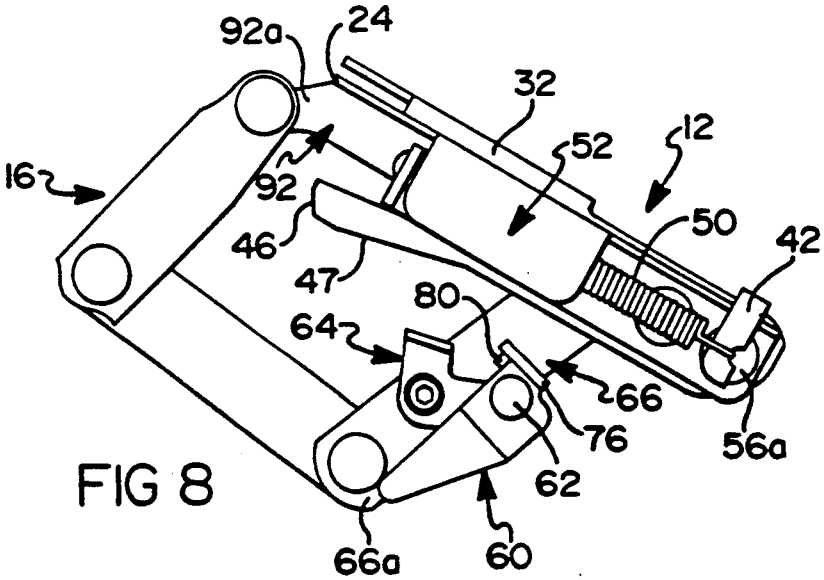
FIG 8

RETRO-FITTABLE EXTENDABLE LEG REST APPARATUS

BACKGROUND OF THE INVENTION

1. Technical Field

This invention relates to leg rest assemblies for recliner chairs, and more particularly to a retro-fittable, controllably extendable leg rest apparatus for positioning a leg rest member of a recliner in retracted and extended positions.

2. Discussion

A leg rest provides significant added comfort when used in connection with recliners. One drawback, however, is that a fixed position leg rest does not accommodate individuals of varying heights particularly well. If the leg rest is fixedly positioned for a relatively short person, the same leg rest will not be optimally positioned for a relatively tall person. For the tall person, the leg rest may be uncomfortably positioned close to or behind the knees, rather than under the feet and calves, thus making the leg rest somewhat uncomfortable to use.

A solution to this problem is disclosed in U.S. Pat. No. 3,695,701, owned by the assignee of the present invention. In this patent an adjustable leg rest is disclosed which can be moved between first and second positions to thereby accommodate, more effectively and comfortably, individuals of widely varying heights.

While the leg rest assembly disclosed in the abovementioned patent has proved to be a significant success in making recliners having protractable leg rests more comfortable for persons of widely varying heights, the retro-fitting of the leg rest assembly of that patent to a wide variety of recliners is not as readily and inexpensively accomplished as might be desired. Typically, when retro-fitting the leg rest of that patent to various recliners the pantograph or scissor linkage assembly of the recliner has to be removed entirely from the frame portion of the recliner, and an entirely new scissor linkage and leg rest assembly connected in its place. This somewhat complicates and renders significantly more expensive the process of retrofitting the leg rest assembly of that patent to various recliners, especially after a recliner has been sold and is located in a private residence.

As mentioned above, while the leg rest disclosed in the above patent has proven to have significant advantages, it would nevertheless be desirable to have an even more simplified and smoothly operating leg rest mechanism, which is even more readily retro-fitted to a wide variety of recliners.

It is therefore a principal object of the present invention to provide a retro-fittable, extendable leg rest apparatus which may be quickly, conveniently, easily and inexpensively retrofitted to a wide variety of previously manufactured and sold recliners having protractable leg rest members.

It is a further object of the present invention to provide a retro-fittable, extendable leg rest apparatus which may be retro-fitted to previously manufactured and sold recliners having protractable leg rest members without special tools, even by the individual owners of such recliners themselves.

It is still a further object of the present invention to provide a retro-fittable, extendable leg rest apparatus which includes an improved mechanism for extending an attached leg rest member into a fully extended position.

It is still another object of the present invention to provide a retro-fittable, extendable leg rest apparatus which includes an improved latching member to positively lock the leg rest member in a forwardly extended position, and to prevent the leg rest member from being retracted until the scissor linkage assembly of the leg rest undergoes a distinct portion of the process of retracting the leg rest member.

SUMMARY OF THE INVENTION

The above and other objects are accomplished by a retro-fittable, extendable leg rest apparatus in accordance with the present invention. The apparatus generally includes an elongated frame bracket having forward and rearward portions, with a shoulder portion extending transversely from its rearward portion. The elongated frame bracket is quickly and easily retro-fittable to a portion of a conventional scissor linkage assembly used in a wide variety of recliners.

Further included is a mounting bracket having first and second bracket portions. The first bracket portion is fixedly secured to a leg rest member of the recliner. The second bracket portion includes forward and rearward end portions, with the forward end portion having a shoulder portion extending therefrom and the rearward portion having a latching edge surface. The second bracket portion further includes an elongated channel through which at least one rivet shank extends. The rivet shank is coupled to a portion of the elongated frame bracket, to thereby form a guide member upon which the elongated channel may move slidably between forwardly extended and retracted positions relative to the elongated frame bracket.

To bias the mounting bracket and the attached leg rest member into a normally retracted position, a biasing means is included and coupled between the shoulder portion of the mounting bracket and the shoulder portion of the elongated frame bracket. A latching member is further provided for releasably latching the mounting bracket and attached leg rest member in the forwardly extended position when the leg rest member is pushed outwardly with the feet of a recliner occupant to the forwardly extended position.

The latching member is coupled to a portion of the scissor linkage assembly, and operates to move pivotally out of engagement with the latching edge surface of the mounting bracket as the scissor linkage assembly is retracted by the user of the recliner.

The retro-fittable, extendable leg rest apparatus of the present invention may thus be quickly, easily and conveniently retro-fitted to a wide variety of recliners having a protractable scissor linkage assembly which supports a leg rest member. An example of such a recliner is a chair sold by the assignee of the present invention under the federally registered trademark RECLINA-ROCKER. The apparatus of the present invention further provides an extremely smooth means by which the leg rest member may be slidably moved between retracted and extended positions, and a positively acting latching means for insuring that the leg rest member is not retracted until the scissor linkage assembly of the recliner is well into its retracting travel.

BRIEF DESCRIPTION OF THE DRAWINGS

The various advantages of the present invention will become apparent to one skilled in the art by reading the following specification and subjoined claims and by referencing the following drawings in which:

FIG. 6 is an elevational side view of the apparatus of the invention in a retracted position and coupled to portions of a scissor linkage assembly of a typical recliner;

FIG. 7 is an elevational side view of the apparatus of the present invention showing the apparatus in a forwardly extended position, and attached to a portion of a typical scissor linkage assembly;

FIG. 8 is an elevational side view of the apparatus showing the apparatus in a retracted position after the scissor linkage assembly to which it is connected has been partially retracted;

DETAILED DESCRIPTION OF THE PREFERRED EMBODIMENTS

Figure 1:
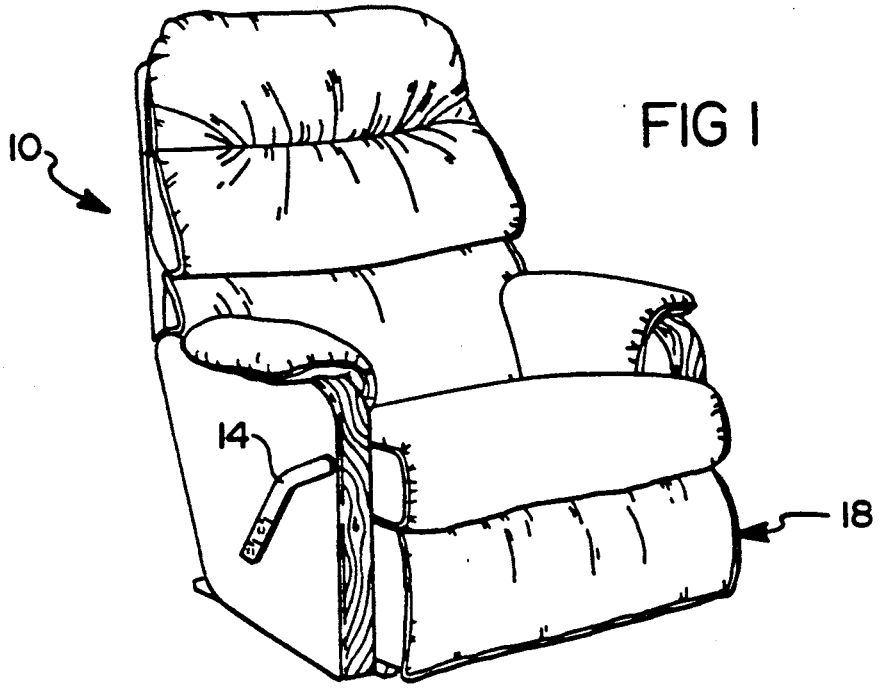
FIG. 1 is an elevational view of a typical recliner with which the present invention may be used.
Figure 2:
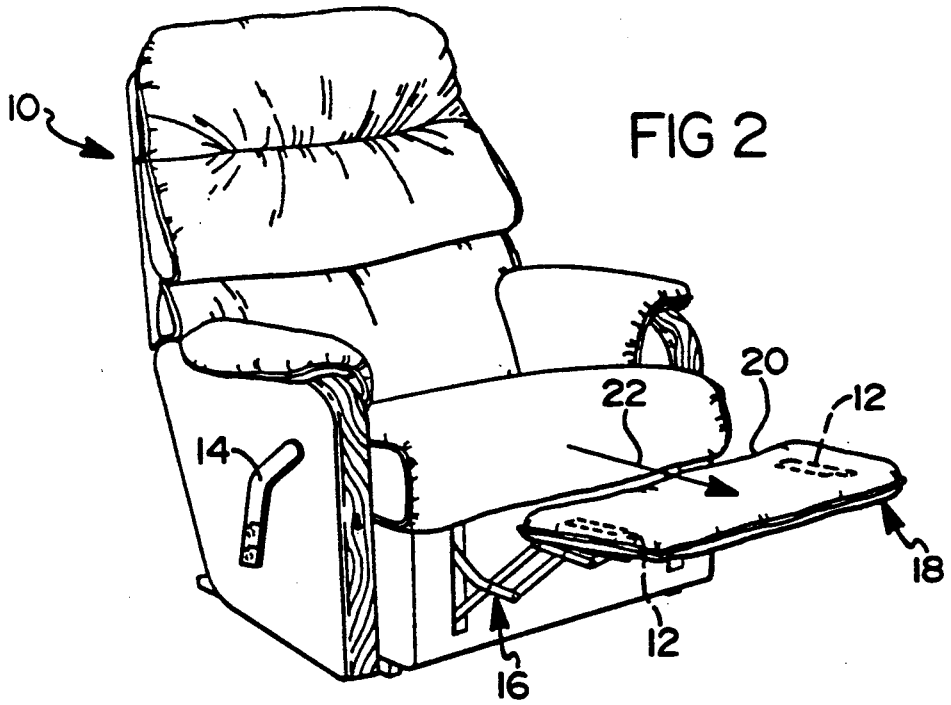
FIG. 2 is an elevational view of a typical recliner with which the present invention may be used showing a leg rest member of the recliner being held by a scissor linkage assembly of the recliner in its forwardly protracted position.
Figure 3:
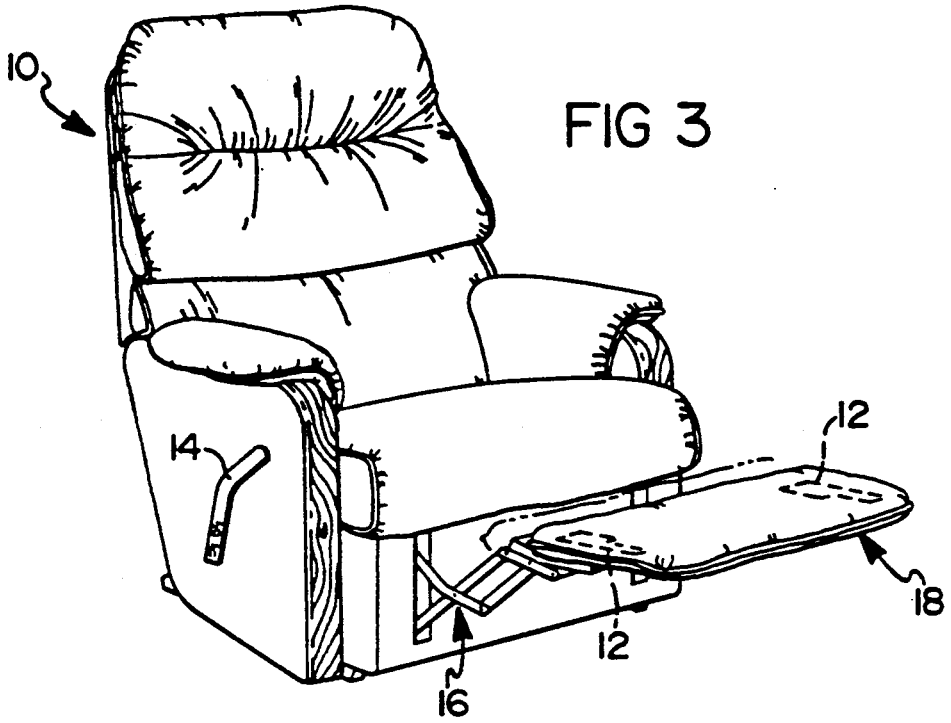
FIG. 3 is an elevational view of a typical recliner showing the leg rest member being moved between its retracted position (shown in phantom lines) and its fully extended position.
Figure 4:
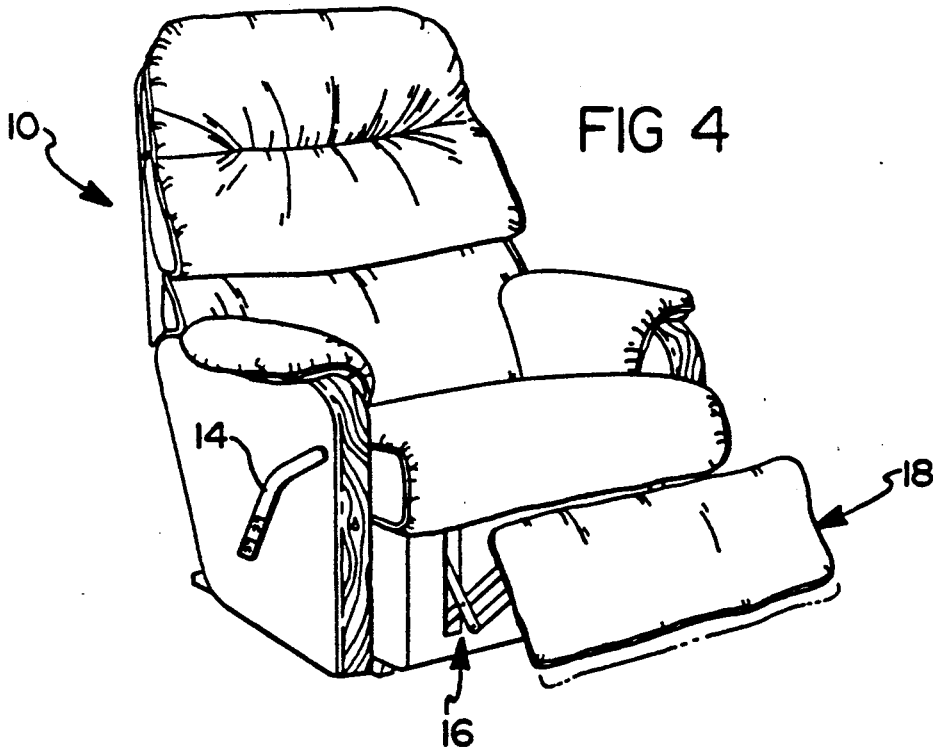
FIG. 4 is an elevational view of a typical recliner showing its scissor linkage assembly partially retracted, and showing the leg rest member being moved from its fully extended position (shown in phantom lines) to its retracted position.

Referring initially to FIGS. 1-4, a recliner chair 10 is illustrated with which the retro-fittable, extendable leg rest of the present invention, shown in phantom in FIGS. 2 and 3 and denoted by reference numeral 12, is adapted to operate. The recliner 10 includes a manually movable lever 14 coupled to a pantograph or scissor linkage assembly 16. A leg rest member 18 is fixedly secured to the leg rest apparatus 12, which is in turn fixedly secured to the scissor linkage assembly 16. The scissor linkage assembly 16 is substantially identical to the scissor linkage assembly disclosed in U.S. Pat. No. 3,695,701, the disclosure of which is hereby incorporated by reference.

Although a detailed description of the mechanical operation of the leg rest apparatus 12 will be provided in the following paragraphs, a brief overview of its operation in connection with recliner 10 will be provided first. Initially, when a seated user of recliner 10 manually pulls upwardly on lever 14 with a counter-clockwise rotation, as shown in FIGS. 1 and 2, scissor linkage assembly 16 is thereby urged into a completely forwardly protracted position, as illustrated in FIG. 2. The seated user of recliner 10 may then place one or both of feet on edge 20 of leg rest member 18 and push outwardly on the leg rest member 18 in the general direction of arrow 22. As indicated by phantom lines in FIG. 3, the leg rest member 18 is then extended outwardly from its initial, or first, position to a fully forwardly extended, or second, position by the leg rest apparatus 12. To retract the leg rest member 18, the seated user simply pushes downwardly on lever 14 in a clock-wise fashion, as seen from the Figures, which causes scissor linkage assembly 16 to fully retract. Alternatively, for certain recliners the user may simply apply a downward force with his feet to the leg rest member 18 to cause the scissor linkage assembly 16 to fully retract. As linkage assembly 16 begins its retractive movement, a latching mechanism of leg rest apparatus 12 causes the apparatus 12 to quickly and positively draw the leg rest member 18 to its original and fully retracted position. Accordingly, the leg rest apparatus 12 enables lever 14 and scissor linkage assembly 16 to perform the dual function of not only retracting the leg rest member back into a foldably retracted position relative to the recliner 10, but also of retracting the leg rest member 18 itself from the fully forwardly extended position to its original retracted position. As mentioned above, the above discussion has been intended only as a general overview of the leg rest apparatus 12 of the present invention and its operation in connection with a typical recliner 10 and scissor linkage assembly 16. A more detailed description of the mechanical operation and assembly of the leg rest apparatus 12 will now be presented.

Figure 5:
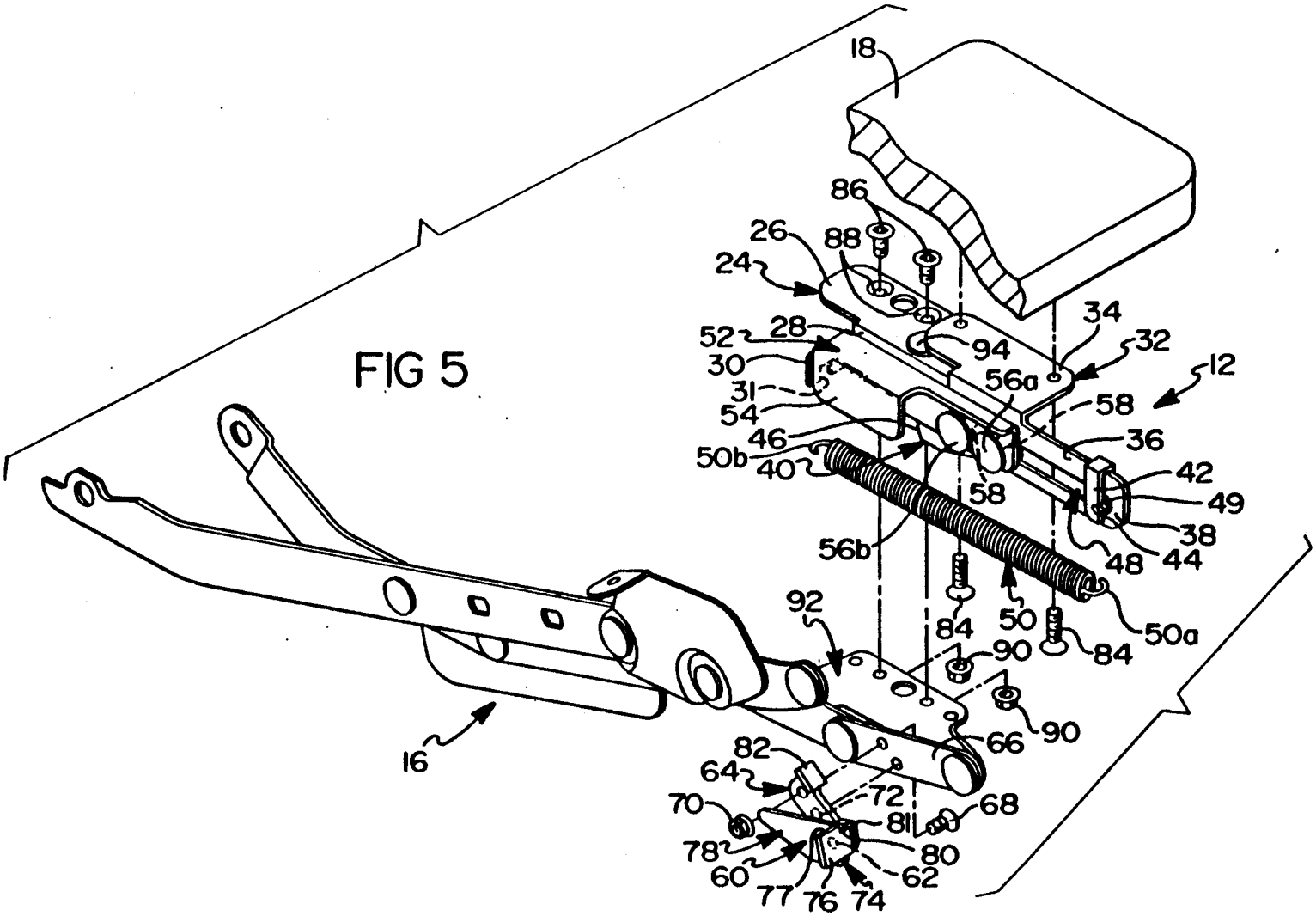
FIG. 5 is an exploded perspective view of the various components of the apparatus of the present invention, as well as a portion of a leg rest member and a portion of a scissor linkage assembly used to protract and retract the apparatus of the present invention and the attached leg rest member.

Referring now to FIG. 5, an exploded perspective view of the leg rest apparatus 12 can be seen together with a portion of leg rest member 18 and a portion of scissor linkage assembly 16. The leg rest apparatus 12 generally comprises an elongated frame bracket 24 having first and second bracket portions 26 and 28 respectively. The second bracket portion 28 includes a transversely extending shoulder portion 30 having a notched portion 31. Leg rest apparatus 12 further comprises a mounting bracket 32 having first and second bracket portions 34 and 36, respectively. The second bracket portion 36 has forward and rearward end portions 38 and 40, respectively. The forward end portion 38 includes a U-shaped shoulder portion 42 having a semi-arcuate notched portion 44, and the rearward end portion 40 has a latching edge surface 46 and a tapered edge surface 47. An elongated channel 48 having a semi-arcuate stop portion 49 is further formed in the second bracket portion 36 of mounting bracket 32, the function of which will be explained below.

Further included in the leg rest apparatus 12 is a coil spring 50 which is adapted to be secured at its opposite ends via hook portions 50*a* and 50*b* with semi-arcuate notch portion 44 of mounting bracket 34 and notched portion 31 of transversely extending shoulder portion 30.

Further included in the leg rest apparatus 12 is an optional shielding bracket 52 having a skirt portion 54. Shielding bracket 52 operates to partially circumscribe coil spring 50 when the coil spring 50 is coupled between U-shaped shoulder portion 42 and transversely extending shoulder portion 30.

With further reference to FIG. 5, to couple the shielding bracket 52, mounting bracket 34 and elongated frame bracket 24 together, and yet enable movement between the mounting bracket 32 and elongated frame bracket 24, a pair of rivets 56*a* and 56*b* are included having shank portions 58, as indicated by hidden lines. The shank portions 58 extend coaxially through independent, longitudinally aligned apertures (not shown) in shielding bracket 54, through elongated channel 48, and through coaxially aligned apertures (not shown) in elongated frame bracket 24. The shank portions 58 form guide members within channel portion 48 to thereby enable the mounting bracket 32 to slidably travel between a fully forwardly extended position and a retracted position, relative to elongated frame bracket 24, in a particularly smooth fashion without binding and with a minimum of mechanical noise. To further enhance the smooth sliding action of mounting bracket 24, optional nylon washers (not shown) may be included and placed over shanks 58 on either side of second bracket portion 36 of mounting bracket 32 (i.e., between shielding bracket 52 and second bracket 36 and between frame bracket 24 and second bracket 36) to enhance the smooth sliding action of mounting bracket 32 even further.

With further reference to FIGS. 5–8, the leg rest apparatus 12 also includes a latching member 60 which is pivotally coupled via a pivot rivet 62 to a stop bracket 64. Stop bracket 64, in turn, is fixedly coupled to a frame link section 66 of scissor linkage assembly 16 via conventional fastening means such as a bolt and nut 68 and 70, respectively, and also an outwardly protruding nipple portion 72, indicated by hidden lines in FIG. 5, which projects into an additional aperture on frame link section 66 to prevent stop bracket 64 from pivoting about bolt 68.

The latching member 60 further includes a forward end portion 74 having a latching shoulder 76 protruding therefrom, and an elongated rearward end portion 78. The latching shoulder portion 76 includes a notched portion 80 which is operable to abuttingly engage with a first shoulder portion 81 of stop bracket 64, to thereby maintain the latching member 60 in a normally unlatched position. The stop bracket 64 further includes a second shoulder portion 82 which is operable to limit the rotational travel of latching member 60 to thereby prevent latching member 60 from becoming jammed or otherwise out of orientation to effect proper latching of latching member 60.

With still further reference to FIG. 5, the first bracket portion 34 of mounting bracket 32 is coupled via threaded bolts 84 to an underside of leg rest member 18. The elongated frame bracket 24 is further coupled via threaded screws 86, which extend through countersunk apertures 88, and which threadably couple with nuts 90, to a mounting link member 92 of scissor linkage assembly 16.

To maintain clearance between the first bracket portion 32 of mounting bracket 34 and the first bracket portion 26 of elongated frame bracket 24, an optional spacer 94 may be included and positioned on first bracket portion 26. Spacer 94 may take the form of a flat head screw, a washer, or the like, and may be bolted or otherwise conventionally secured to the first bracket portion 26 to assure a minimum clearance between first bracket portion 34 of mounting bracket 32 and the first bracket portion 26 of elongated frame bracket 24.

Referring now to FIGS. 6–8, a description of the operation of the leg rest apparatus 12 will be provided. With initial reference to FIG. 6, the leg rest apparatus 12 is shown in the retracted position with its scissor linkage assembly 16 shown in a fully, outwardly protracted position. In the retracted position, coil spring 50 exerts a tensioning force on U-shaped shoulder portion 42 to maintain mounting bracket 32 and attached leg rest member 18 (not shown) in a fully retracted position. At this point, stop portion 49 of elongated channel 48 is in abutting contact with the shank 58 of rivet 56*a*, thereby acting as a stop to limit the retractive travel of mounting bracket 32.

As shown in FIG. 7, as the mounting bracket 32 is urged outwardly in the direction indicated by directional arrow 98 by applying a force on edge 20 of leg rest member 18 (not shown) (such as with the feet), an edge 77 of latching shoulder 76 rides across and is forced downwardly by the tapered edge 47 of mounting bracket 32. As the mounting bracket 32 reaches a completely, forwardly extended position, latching shoulder 76 clears latching edge surface 46 thereby allowing it once again to pivot freely about rivet 62, and the mass of elongated end portion 78 of latching member 60 causes the latching member 60 to pivot about rivet 62 in a counter-clockwise manner, as viewed from FIG. 7. In the preferred embodiment shown, latching shoulder 76 will not clear latching edge surface 46 unless the scissor linkage assembly 16 is substantially fully protracted. The counter-clockwise rotation of latching member 60 causes the latching shoulder 76 to rotate into parallel alignment with latching edge surface 46 of the mounting bracket 32. The first shoulder portion 81 of stop bracket 64 serves to stop the counter-clockwise rotational movement of the latching member 60 at precisely the proper point to assure positive, parallel, and abutting engagement with latching edge surface 46 will take place.

As the force or pressure applied (such as by the recliner user's feet) is released slightly, the mounting bracket 32 retracts just slightly in response to the tensioning force exerted by coil spring 50, before positive, abutting contact occurs between latching shoulder 76 and latching edge surface 46. At this point, the mounting bracket 32 and attached leg rest member 18 (not shown) will be held positively by the latching member 60 in a completely, forwardly extended position.

With reference now specifically to FIG. 8, the automatic retraction of the leg rest apparatus 12 will be described. As scissor linkage assembly 16 is retracted by manual movement of lever 14 (shown in FIGS. 1–4), the end portion 66*a* of frame link 66 and end portion 92*a* of mounting link 92 move pivotally away from each other, thereby causing the first shoulder portion 81 of fixedly secured stop bracket 64 to urge latching shoulder 76 away from latching edge surface 46 of mounting bracket 32. At this point, the tensioning force exerted by coil spring 50 on U-shaped shoulder portion 42 causes the mounting bracket 32 to be quickly, smoothly, and positively slidably drawn in to a fully retracted position, as shown in FIG. 8. The mounting bracket 32 remains in its fully retracted position by the tensioning force exerted by coil spring 50 and abutting contact with the semi-arcuate stop portion 49 of elongated channel 48 and the shank (shown in FIG. 5) of rivet 56*a*.

Figure 9:
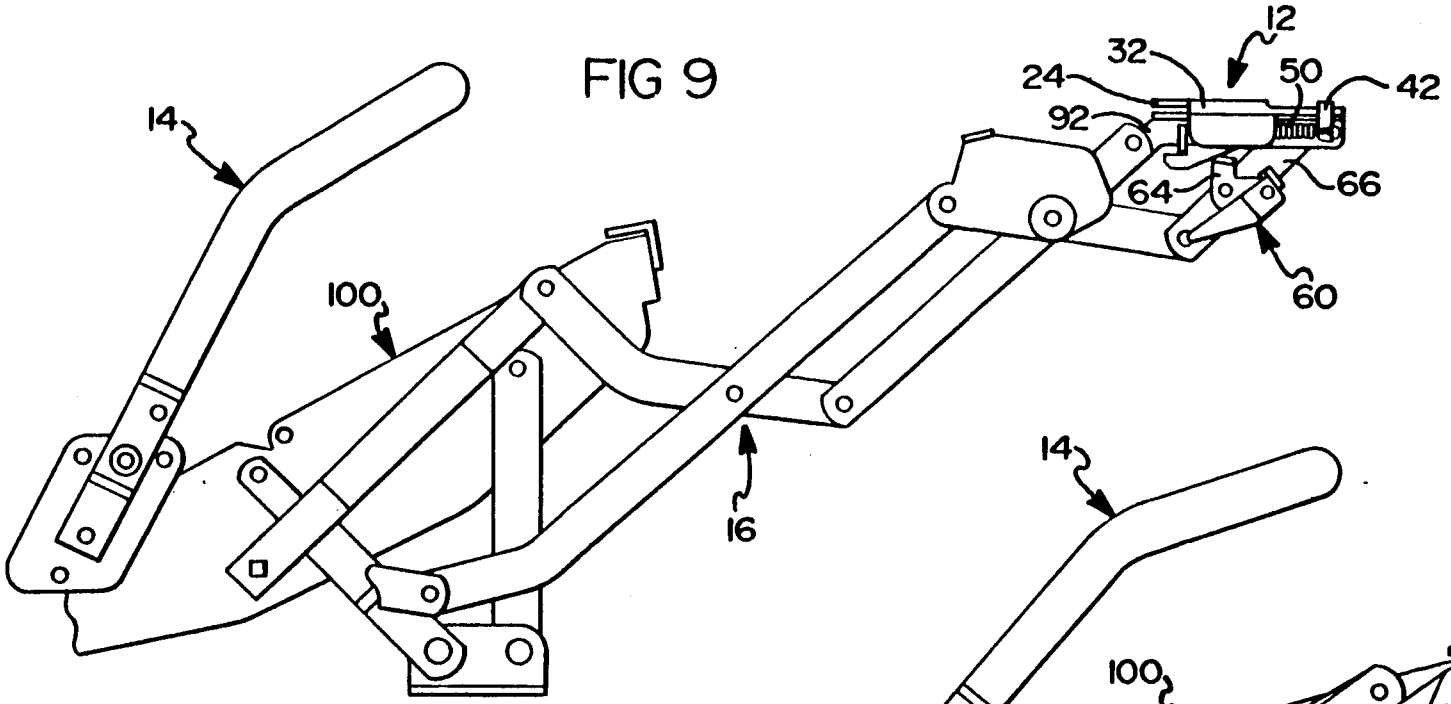
FIG. 9 is an elevational side view of the apparatus of the present invention showing the apparatus in the retracted position, as well as being connected to a fully protracted scissor linkage assembly and a portion of the recliner seat and attached leg rest handle (the scissor linkage assembly, recliner seat portion, and leg rest handle all being shown in schematic)
Figure 10:
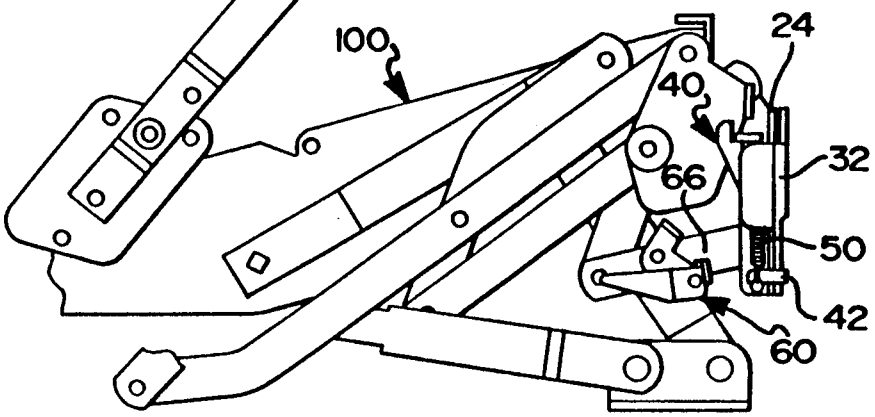
FIG. 10 is an elevational side view of the apparatus as shown in FIG. 9 with the scissor linkage assembly in a fully retracted position.

With reference now to FIG. 9, the scissor linkage assembly 16 coupled to a frame portion 100 of recliner 10 is shown in its completely protracted position together with leg rest apparatus 12, which is attached to the forward end thereof, in its completely retracted position. The mounting bracket 32 of the leg rest apparatus 12 is positioned in a substantially horizontal position by the scissor linkage assembly 16 when assembly 16 is in a fully outwardly protracted position. When the handle 14 is moved in a clockwise manner, as viewed in FIG. 10, the linkage assembly 16 foldably collapses to place the mounting bracket 32, and thus leg rest member 18 (not shown), in a substantially vertical, tucked-in or stored position.

A principal advantage of the leg rest apparatus 12 is that it may be quickly, easily and conveniently retro-fitted to existing scissor linkage assemblies of various recliners. Heretofore, it was necessary to replace the entire scissor linkage assembly when attempting to retro-fit a particular recliner 10 with an extendable leg rest. With the present invention, an improved smooth sliding and positively latching extendable leg rest assembly may be retro-fitted to previously manufactured and sold recliners by simply removing the leg rest member 18 from the mounting link 92 of the scissor linkage assembly 16, securing the elongated frame bracket 24 to the mounting link 92, securing the stop bracket 64 and latching member assembly 60 to the frame link section 66 of the scissor linkage assembly 16, and reattaching the leg member 18 by securing it to the mounting bracket 32 of the leg rest apparatus 12. In addition, no special tools are needed to effect the retro-fitting of the leg rest apparatus 12. The retro-fitting may be accomplished by individual owners of recliners in the convenience of their own homes, thus obviating the need to have service personnel come to the home or, alternatively, to ship the recliner 10 to a service facility. Hence, the leg rest apparatus 12 having few parts and thus being relatively easy to manufacture, provides and inexpensive and easy to install solution to recliners having a single position leg rest member. Various components of the leg rest apparatus 12 are preferably constructed of rigid materials such as mild steel or other metal. It should be appreciated, however, that other structurally rigid materials could also be used.

Further advantages of the leg rest apparatus 12 of the present invention, as discussed briefly above, are a smoothly sliding action effected by the cooperative workings of shanks 58 of rivets 56*a* and 56*b*, and elongated channel 48 of the mounting bracket 32. Another advantage is the improved positively acting latching member 60 which prevents accidental disengagement thereof with the mounting bracket 32 by preventing mounting bracket 32 from being retracted until the scissor linkage assembly has been at least partially retracted by lever 14. In this manner, movement or jostling of the recliner 10 can not accidentally effect a disengagement of the latching member 60, and therefore an unintended retraction of the leg rest member 18 by leg rest apparatus 12. In addition, the scissor linkage assembly 16 does not have to be completely retracted before the leg rest apparatus can be re-extended. Simply re-protracting the scissor linkage assembly 16 via lever 14 to the fully protracted position will enable the leg rest apparatus to be re-extended if so desired.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A retro-fittable, extendable leg rest apparatus, said apparatus comprising:

an elongated frame bracket operable to be retrofittably secured to a scissor linkage assembly, said elongated frame bracket having a shoulder portion extending therefrom;

a mounting bracket having first and second bracket portions, said first bracket portion being operable to be secured to a leg rest member, said second bracket portion having forward and rearward end portions, said forward end portion including a shoulder portion and said rearward end portion having a latching edge surface, said second bracket portion further including an elongated channel formed therein;

securing means extending through said elongated channel of said mounting bracket for slidably securing said mounting bracket to said elongated frame bracket, thereby enabling said mounting bracket to be slidably extended and retracted along said channel relative to said elongated frame bracket;

biasing means coupled between said shoulder portion of said elongated frame bracket and said shoulder portion at said forward end portion of said mounting bracket for maintaining said mounting bracket in a normally retracted position relative to said elongated frame bracket; and latching means pivotally coupled to a portion of said scissor linkage assembly for releasably latching with said latching edge surface of said mounting bracket when said mounting bracket is extended forwardly relative to said elongated frame bracket, to thereby releasably maintain said mounting bracket in a forwardly extended position, said latching means further being operable to pivotally unlatch with said latching edge surface of said mounting bracket as said scissor linkage assembly is urged into a retracted position.

2. The apparatus of claim 1, further comprising a shielding bracket coupled intermediate said securing means and said second bracket portion of said mounting bracket for partially enclosing said biasing means.

3. The apparatus of claim 1, further comprising washer means disposed intermediate said elongated frame bracket and said mounting bracket and secured therebetween by said securing means, said washer means further enabling said second bracket portion of said mounting bracket to be smoothly urged between said forwardly extended position and said retracted position.

4. The apparatus of claim 1, wherein said second bracket portion of said elongated frame bracket includes an aperture therein; and wherein said securing means includes at least one rivet having a shank, said shank extending through said elongated channel and said aperture in said second bracket portion of said elongated frame bracket.

5. The apparatus of claim 4, wherein said shank of said rivet further operates as a stop to limit forward and rearward travel of said mounting bracket when said mounting bracket is extended to its forwardly extended position and when said mounting bracket is retracted from said forwardly extended position to said retracted position by said biasing means.

6. The apparatus of claim 1, wherein said biasing means comprises a coil spring.

7. The apparatus of claim 1, wherein said latching means comprises forward and rearward end portions, said forward end portion having a latching shoulder protruding therefrom operable to releasably latch into abutting engagement with said latching edge surface of said second bracket portion of said mounting bracket, and said rearward end portion of said latching means having a sufficient mass to cause said latching shoulder to be pivotally urged into abutting contact with said latching edge surface of said mounting bracket when said mounting bracket is urged into said forwardly extended position.

8. The apparatus of claim 1, further including a stop bracket coupled to a portion of said scissor linkage assembly, said stop bracket having a first shoulder portion for maintaining said latching means in a position of ready engagement with said latching edge surface of said mounting bracket as said mounting bracket is urged to said forwardly extended position, and operable to urge said latching means out of latching engagement with said latching edge surface as said scissor linkage assembly is urged into said retracted position.

9. The apparatus of claim 8, wherein said stop bracket further includes a second shoulder portion operable to limit rotational travel of said latching means.

10. A retro-fittable, manually extendable leg rest apparatus for controllably moving a recliner chair leg rest member secured to said apparatus between first and second positions, said apparatus comprising:

an elongated frame bracket having first and second bracket portions, said first bracket portion operable to be retro-fittably secured to a mounting link section of a scissor linkage assembly of a recliner, said second bracket portion of said elongated frame bracket having forward and rearward end portions, said forward end portion having at least two longitudinally aligned apertures, said rearward end portion having a transversely extending shoulder portion;

a mounting bracket having first and second bracket portions, said first bracket portion of said mounting bracket being secured to a leg rest member of said recliner, said second bracket portion of said mounting bracket having forward and rearward end portions, said forward end portion having a U-shaped shoulder portion and said rearward end portion having a latching edge surface, said second bracket portion of said mounting bracket further including an elongated channel formed therein;

at least two rivets, each said rivet having a shank extending through said elongated channel and through one of said apertures in said second bracket portion of said elongated frame bracket, said shanks of said rivets operating to provide guide members upon which said elongated channel may slidably move, to thereby enable said mounting bracket to be slidably urged into a forwardly extended position and into a retracted position;

a coil spring coupled between said U-shaped shoulder portion of said mounting bracket and said transversely extending shoulder portion of said elongated frame bracket to provide a biasing force to maintain said mounting bracket in a normally retracted position, and to forcibly urge said mounting bracket into said retracted position from said forwardly extended position when said scissor linkage assembly is retracted from an outwardly protracted position;

a stop bracket fixedly secured to a portion of said scissor linkage assembly, said stop bracket having first and second shoulder portions; and a latching member pivotally secured to a portion of said stop bracket, said latching member further having a forward end portion including a shoulder portion and an elongated rearward portion, said elongated rearward portion having sufficient mass to maintain said shoulder portion of said latching member pivotally in abutting engagement with said first shoulder portion of said stop bracket, whereby said shoulder portion of said latching member is maintained in a position of ready engagement with said latching edge surface of said mounting bracket when said mounting bracket is urged into said forwardly extended position, said elongated rearward end portion of said latching member being operable to limit the degree of pivotal movement of said latching member to further adapt said latching member into said position of ready engagement with said latching edge surface of said mounting bracket.

11. The apparatus of claim 10, further comprising a shielding bracket having a skirt portion, said shielding bracket being coupled by said rivets intermediate head portions of said rivets and said second bracket portion of said mounting bracket, said skirt portion of said shielding bracket being operable to partially circumscribe a portion of said coil spring.

* * * * *